US010221681B2

(12) United States Patent
McEwen-King et al.

(10) Patent No.: US 10,221,681 B2
(45) Date of Patent: Mar. 5, 2019

(54) MONITORING OF STEAM INJECTION

(71) Applicant: OPTASENSE HOLDINGS LIMITED, Farnborough, Hampshire (GB)

(72) Inventors: Magnus McEwen-King, Farnborough (GB); David Hill, Farnborough (GB)

(73) Assignee: OPTASENSE HOLDINGS LIMITED (GB)

( * ) Notice: Subject to any disclaimer, the term of this patent is extended or adjusted under 35 U.S.C. 154(b) by 159 days.

(21) Appl. No.: 15/031,573

(22) PCT Filed: Nov. 4, 2014

(86) PCT No.: PCT/GB2014/053273

§ 371 (c)(1),
(2) Date: Apr. 22, 2016

(87) PCT Pub. No.: WO2015/067931

PCT Pub. Date: May 14, 2015

(65) Prior Publication Data

US 2016/0251957 A1 Sep. 1, 2016

(30) Foreign Application Priority Data

Nov. 5, 2013 (GB) ..... 1319553.2

(51) Int. Cl.
*E21B 47/12* (2012.01)
*E21B 43/24* (2006.01)
*E21B 47/06* (2012.01)

(52) U.S. Cl.
CPC ..... *E21B 47/123* (2013.01); *E21B 43/2406* (2013.01); *E21B 47/06* (2013.01); *E21B 47/065* (2013.01)

(58) Field of Classification Search
CPC .... E21B 43/2406; E21B 47/06; E21B 47/065; E21B 47/123
See application file for complete search history.

(56) References Cited

U.S. PATENT DOCUMENTS 6,547,435 B1 4/2003 Grosswig et al.
8,439,106 B2 * 5/2013 Hammami ..... E21B 47/011 166/250.01

(Continued)

FOREIGN PATENT DOCUMENTS

GB 2442745 4/2008
GB 2 492 095 12/2012

(Continued)

*Primary Examiner* — Elias Desta
(74) *Attorney, Agent, or Firm* — McDonnell Boehnen Hulbert & Berghoff LLP

(57) ABSTRACT

Methods and apparatus for monitoring steam injection in a steam assisted well are disclosed. The method involves obtaining a first temperature profile of a well by performing distributed temperature sensing on a first fiber optic. The method also obtains a second temperature profile of the well by interrogating a second fiber optic to provide distributed sensing of temperature variations. Interrogating the second fiber optic comprises repeatedly launching interrogations of one or more pulses of coherent radiation into said second fiber optic, detecting any radiation which is Rayleigh backscattered from each interrogation and analyzing the detected backscattered radiation to detect any variation between interrogations due to temperature variation. The method combines said first and second temperature profiles to provide a steam injection profile. The method may also involve determining an acoustic profile of the well through distributed acoustic sensing. Measurements from a small number of downwell point temperature and pressure sensors may also be used to determine the steam injection profile.

24 Claims, 2 Drawing Sheets

(56) References Cited

U.S. PATENT DOCUMENTS

| | | | | |
|---|---|---|---|---|
| 2004/0112596 | A1 | 6/2004 | Williams et al. | |
| 2006/0146337 | A1 | 7/2006 | Hartog | |
| 2014/0334262 | A1* | 11/2014 | Brune ..... | G01V 1/003 367/86 |

FOREIGN PATENT DOCUMENTS

| | | |
|---|---|---|
| WO | WO2002/057805 | 7/2002 |
| WO | WO 2008/098380 | 8/2008 |
| WO | WO2012/082488 | 6/2012 |
| WO | WO2012/137021 | 10/2012 |
| WO | WO2012/137022 | 10/2012 |
| WO | WO2013/032687 | 3/2013 |

* cited by examiner

MONITORING OF STEAM INJECTION

FIELD OF THE INVENTION

The present invention relates to methods and apparatus for downhole monitoring of steam injection in wells (in particular, oil and bitumen wells), and in particular to monitoring using one or more fibre optic sensors.

BACKGROUND OF THE INVENTION

In order to extract oil efficiently from certain oil fields, in particular those which contain viscous oil or bitumen deposits, steam is sometimes used usually with the primary purpose of increasing the temperature of the deposit (thereby lowering its viscosity), in large part by transferring heat as the steam condenses. Generally, steam is introduced though an 'injection' well shaft, and the heated deposit is removed via a 'production' well shaft.

As will be familiar to the skilled person, there are various steam stimulation techniques. For example, in Steam Assisted Gravity Draining (SAGD), when a reservoir containing a viscous resource deposit has been identified and geology allows, two bores are drilled, both with horizontal sections in the reservoir, an upper shaft running above a lower shaft. To allow thick, tar-like resources to flow, steam is injected through the upper shaft (and also, in some wells, initially through the lower shaft) causing the resource to heat up, liquefy and drain down into the area of the lower 'production' shaft, from which it is removed.

Other related techniques are 'steam flooding' (also known as 'continuous steam injection'), in which steam is introduced into the reservoir though (usually) several injection well shafts, lowing the viscosity, and also, as the steam condenses to water, driving the oil towards a production well shaft. In a variant of this, so-called cyclic steam injection, the same shaft may function both as an injection well shaft and as a production well shaft. First, steam is introduced (this stage can continue for a number of weeks), then the well is shut in, or sealed, allowing the steam to condense and transfer its heat to the deposit. Next, the well is re-opened and oil is extracted until production slows down as the oil cools. The process may then be repeated.

In some instances steam injection techniques may be applied to existing wells that were not originally steam assisted to improve and/or maintain production beyond which could be achieved in the absence of steam stimulation.

Steam injection may be achieved in various ways depending on the type of well and steam assistance being employed. For example some conventional steam injection well shaft casings typically included a long slot from which the steam is released in order to achieve even heating of the reservoir. However, as the steam tends to follow the path of least resistance within the reservoir, heating can be localised. This meant that the so-called 'steam cavern' or 'steam chamber' formed could be irregular in shape, leading to inefficient production and the risk of 'steam breakthrough' whereby steam finds its way to the production well, mixing with the oil as it is extracted.

More recently injection well casings have been designed with number of discrete vents with slide valves rather than single long slots. Examples are described in WO2012/082488 and WO2013/032687 in the name of Halliburton, which also produces a commercial product known as the sSteam™ Valve. Such valves may be selectively controlled, based for example on an estimation of the shape of the steam chamber, to try to improve the shape by selective injection of steam along the length of an injection well shaft.

For the various steam assisted approaches it would be beneficial to be able to monitor the characteristics of the steam injection. This may be useful simply for providing information about the overall effect on the reservoir but in some applications it may be possible to control the steam injection, i.e. vary the overall flow rate or pressure or selectively control individual valves along the length of the injection well so as to achieve a desired profile.

SUMMARY OF THE INVENTION

Embodiments of the present invention relate to methods and apparatus for determining and/or monitoring various parameters related to steam injection downhole.

Thus according to the present invention there is provided a method of monitoring steam injection in a steam assisted well comprising:

- obtaining a first temperature profile of at least a first portion of a well by performing distributed temperature sensing on a first fibre optic deployed along said first portion of the well;
- obtaining a second temperature profile of at least the first portion of a well by interrogating a second fibre optic deployed along the first portion of the well to provide distributed sensing of temperature variations, wherein interrogating said second fibre optic comprises repeatedly launching interrogations of one or more pulses of coherent radiation into said second fibre optic, detecting any radiation which is Rayleigh backscattered from each interrogation and analysing the detected backscattered radiation to detect any variation between interrogations due to temperature variations; and
- combining said first and second temperature profiles to provide a steam injection profile.

The method of the present invention uses the techniques of fibre optic distributed temperature sensing in combination with a Rayleigh based fibre optic distributed sensing technique.

Fibre optic distributed temperature sensing (DTS) is a known technique wherein an optical fibre can be repeatedly interrogated with interrogating radiation and interrogating light which has been subjected to Brillouin and/or Raman scattering is detected. By looking at the characteristics of the Brillouin frequency shift and/or the amplitudes of the Stokes/anti Stokes components the absolute temperature of a given portion of fibre can be determined. By using optical time domain reflectometry (OTDR) type techniques the light scattered from distinct portions of fibre can be time gated and analysed to determine a temperature for each of a plurality of discrete longitudinal temperature sensing portions of fibre.

The use of DTS therefore allows a temperature profile to be obtained along the length of at least the first part of the well, which typically will be the well being used for steam injection. The temperature profile may, in effect, be a temperature profile along the steam injection line of the well. This temperature profile, which is a profile of absolute temperature, can be used to indicate a steam profile along the relevant length of the well. The temperature profile produced by DTS is useful, however it has been appreciated that DTS requires a relatively long time integration for measurements and thus does not provide a real-time picture of temperature. Also the temperature resolution of DTS can be relatively limited.

The method of embodiments of the present invention thus also interrogates a second optical fibre, which or may not be the same optical fibre as the first optical fibre, to determine the Rayleigh backscatter from the optical fibre and uses variation in the detected Rayleigh backscatter radiation to determine any temperature changes along the length of the second optical fibre.

As will be understood by one skilled in the art there are various types of scattering processes that may occur when radiation is propagating within an optical fibre. As mentioned above light may be subject to Brillouin scattering and/or Raman scattering. These scattering processes are inelastic and typically involve a frequency shift in the scattering radiation compared with the frequency of the interrogating radiation. Rayleigh backscattering is a different scattering process that results from scattering from inherent scattering sites within the fibre optic. Rayleigh backscattering is an elastic scattering processes and thus the radiation that is Rayleigh backscattered has the same frequency as the interrogating radiation.

Coherent Rayleigh scattering is the basis of the known technique of distributed acoustic sensing (DAS). DAS is a type of sensing that interrogates an optical fibre with one or more pulses of coherent optical radiation and detects any radiation which is Rayleigh backscattered from within said fibre. Again the backscattered light can be grouped into time bins using the principles of OTDR to provide an indication of the Rayleigh backscatter from a given sensing portion of fibre.

The amount of Rayleigh scattering from any given sensing portion of fibre will depend on the distribution of scattering sites within that sensing portion. Each scattering site can be thought of as a small reflector acting to reflect a small portion of the interrogating radiation back to the front of the fibre. Given that the interrogating radiation is coherent the scattering from different scattering sites will interfere. The intensity of the radiation backscattered from the fibre optic will vary randomly along the length of the fibre due to the random variations in scattering sites. However, in the absence of any environmental stimulus and assuming the properties of the interrogating radiation remain the same, then the radiation which is Rayleigh backscattered from any given sensing portion of the fibre should have the same properties from one interrogation to the next. However any strain acting on the fibre which results in a change in effective path length of the relevant sensing portion will lead to a change in the resultant backscatter interference signal from that sensing portion. This change in properties may be detected as a change in intensity or, in some embodiments, as a change in phase, and used to indicate a dynamic strain acting on the relevant portion of the optical fibre.

It will be noted that in such sensors and also in DTS the sensing function is distributed throughout the whole optical fibre and relies on the inherent scattering processes within an optical fibre, rather than specifically introduced reflection sites such as fibre Bragg gratings or the like (although Raman or Brillouin scattering relies on a different scattering process to Rayleigh scattering). Thus the size and distribution of the sensing portions of optical fibre can be varied just be changing the properties of the interrogating radiation and the time bins in which the backscatter is analysed. The term distributed sensor as used herein therefore shall be taken to mean a fibre optic sensor where the sensing function is distributed throughout the fibre optic in this way.

Such DAS sensors have typically been used to detect relatively fast acting dynamic strains, e.g. incident acoustic signals. However it will be understood that the same principles can be applied to detecting dynamic changes caused by a change in temperature and hence path length of the relevant sensing portions (due to the resultant strain and/or refractive index modulation).

Thus in embodiments of the present invention the method involves repeatedly launching interrogations of one or more pulses of coherent radiation into said second fibre optic, detecting any radiation which is Rayleigh backscattered from each interrogation and analysing the detected backscattered radiation to detect any variation between interrogations due to temperature variations. Using these principles of DAS to monitor temperature changes in this way can provide measurements of very small changes in temperature and can provide measurements which responds quickly of any changes in temperature. This technique can resolve temperature variations of less than 1 milliKelvin and can respond to rapid changes in temperature, providing effectively real-time monitoring.

The use of Rayleigh backscatter in this way to determine any temperature variations acting on discrete sensing portions of a sensing optical fibre shall be referred to herein as Distributed Temperature Gradient Sensing (DTGS).

The method therefore uses this DTGS technique to obtain a second temperature profile, in addition to DTS temperature profile (the first temperature profile). The second temperature profile is thus a profile of temperature changes along the length of the well, rather than absolute temperature but typically will have a better temperature resolution in terms of temperature variation and with a better temporal response to any changes.

The method of the present invention thus combines the first (DTS) and second (DTGS) temperature profile to form a steam injection profile. The steam injection profile may thus comprise and/or be based on a combined temperature profile.

The method may therefore use the first temperature profile as a scaler reference profile for the second temperature profile to create a resultant temperature profile. In effect the method may start with the reference values of the DTS profile and modulate this temperature profile by the temperature variations indicated by the second temperature profile.

In some embodiments the method may additionally comprise taking at least one temperature measurement from a point temperature sensor located at a location along the first portion of the well. A point temperature sensor may be used to determine a high accuracy and high resolution temperature measurement, for example within the well casing. The point temperature sensor measurement may provide additional high accuracy temperature information which can be used to add to the steam injection profile. It will be appreciated that a point temperature sensor may provide a more accurate and higher resolution measurement than is possible with DTS. However it may not be practical and/or cost effective to provide sufficient point sensors along the length of the portion of well to be monitored to provide the temperature profile information. Thus the method may use DTS, which simply requires one optical fibre deployed along the path of the well, to determine a first temperature profile but may use at least one point temperature sensor to aid in calibrating the DTS sensor. The method may therefore comprise calibrating the first temperature profile based on the measurement from the at least one point temperature sensor. In some embodiments there may be at least two point temperature sensors, one located towards the beginning of the section of well to be monitored and the other located towards the end of the section of well to be monitored. For example in a well with a generally horizontal section where steam is to be injected the well may have a "heel" portion (at the proximal end of the horizontal section) and a "toe" portion (at the distal end of the horizontal section). Point temperature sensors may be arranged in the heel and toe portions with the first (and second) optical fibre(s) running between the heel and toe section. In some arrangements the heel and toe temperature measurements may be used to calibrate the first temperature profile. The point temperature sensor may be any suitable type of temperature sensor as will be understood by one skilled in the art.

Additionally or alternatively the method may additionally comprise taking at least one pressure measurement from a pressure sensor located at a location along the first portion of the well. The or each pressure sensor may be a point pressure sensor. Taking pressure measurements can aid in producing a steam injection profile. The steam injection profile may therefore comprise a measure of the pressure variation along the first portion of well. The pressure values determined may be included into the steam injection profile. Additionally or alternatively the pressure determined along the portion of well may be used to correct the second temperature profile (e.g. the DTGS) for pressure drops. For example pressure sensors located towards the proximal and distal ends of a portion of well respectively, e.g. in the heel and toe portions, may be used to determine a pressure variation along the length of the portion and the resulting temperature profile may include the pressure variation, e.g. pressure profile, and/or may adjusted to compensate for pressure induced variations in the temperature measurements. The result may be a pressure compensated temperature profile.

The method may, in some embodiments, comprise obtaining a first acoustic profile of at least the first portion of a well by performing distributed acoustic sensing on a third fibre optic deployed along said first portion of the well.

As mentioned above distributed acoustic sensing is a known technique for detecting relatively fast acting dynamic strains/vibrations acting on a sensing optical fibre. The method may therefore involve interrogating a third optical fibre, which may or may not be the same as either the first and/or second optical fibre, to perform distributed acoustic sensing (DAS). As mentioned DAS may involve repeated launches of one or more pulse of coherent radiation and detection and analysis of radiation which is Rayleigh backscattered from within said fibre to detect any acoustic stimuli acting on the fibre. Note the DAS acoustic profile is in addition to the DTGS profile mentioned above. The DTGS profile is obtained to substantially represent temperature variations whereas the DAS profile is obtained to substantially indicate any relatively fast acting stimulus on the sensing fibre. It will therefore be appreciated that the acoustic stimuli of interest will have a greater frequency than any temperature variations.

Detecting an acoustic profile along the first portion of the well can be used to determine the flow of steam along, and out of, the first portion of the well. Various acoustic characteristics may be determined for instance the acoustic intensity or power, possibly at specific frequencies or within frequency bands or the spread of acoustic power with frequency could be determined. Spectral characteristics such as dominant frequencies or frequency bands or the frequency spread could be determined.

It will be appreciated that as steam flows along a steam injection flow line into a well and escapes from one or more vents into the surrounding environment there may well be characteristic acoustic signals. For instance the relative acoustic intensity before and after a particular steam vent, i.e. location in the steam injection line where steam can escape to the environment, may provide an indication of the relative proportion of steam that is flowing into the environment from that vent. The intensity of an acoustic signal at a vent may be indicative of the flow rate through the vent. A frequency associated with steam escaping through a vent may be characteristic of the flow rate through such a vent.

In some embodiments the acoustic profile may be combined with data regarding the steam flow rate at the surface. For instance the acoustic profile may be normalised based on the present flow rate of steam at the well head. Other well head factors such as well head steam pressure may also be used to calibrate or normalise the acoustic profile.

The method may comprise combining the acoustic profile and the first and second temperature profiles to form the steam injection profile. As discussed above the first and second temperature profiles may be used, optionally with additional temperature and/or pressure measurements to determine a combined temperature profile which provides an indication of absolute temperature but which is also high resolution and fast responding. The temperature profile may be combined with the acoustic profile to provide an overall steam injection profile. By looking at the way that the acoustic profile varies along the first portion of the well together with the way the temperature varies along the well it will be possible to form an overall profile of the steam flow along and out of the well and thus an indication of the steam injection profile.

In some embodiments the steam injection profile may also make use of at least one well head measurement such as steam flow rate, surface steam temperature, surface steam pressure, steam quality etc. Various parameters of the steam injection process can be monitored at well head and used to form a steam injection profile.

It is known that the steam flow regime can vary based on the temperature and pressure downwell. By accurately determining the temperature profile, together with other information such as the acoustic data regarding relative flow, it can be possible to estimate the flow regime that is occurring from the measured temperature profile and additional data.

In essence the method may form a model of steam flow within the well and use the first and second temperature profiles (optionally including downwell pressure and/or point temperature measurements) and the acoustic profile if present to determine a modelled steam flow profile that matches that measured profiles. As mentioned well head measurements may also be used to constrain the parameters to determine the steam injection profile.

The factors affecting the flow regime of saturated steam/vapour are relatively well understood and one skilled in the art would be aware of how to construct a suitable model.

The methods of the present invention thus make use of a variety of fibre optic sensing techniques to acquire different measurement profiles of at least a first portion of a well and combine said various profiles to provide a steam injection profile. The use of fibre optic sensors allows relatively low cost sensors that can monitor substantially the whole injection and/or production zone of a steam assisted well without requiring significant downhole equipment. In some embodiments a single fibre optic cable may be used for both DTS and coherent Rayleigh sensing (e.g. DTGS and/or DAS sensing) although in other embodiments there may be separate fibres for coherent Rayleigh type sensing and DTS type sensing (and/or there may be different optical fibre for DTGS sensing and DAS sensing). The measurements may be augmented with measurements from a small number of point sensors, such as point temperature sensors for accurate high resolution temperature sensors and/or pressure sensors, but only a small number of such sensors are required—thus avoiding the cost and complexity of large numbers of point sensors. Such point sensors may, for instance, be located towards the proximal and distal ends of the portion of well to be monitored to provide calibration towards the ends of the monitored section.

The optical fibre(s) used for sensing may be located within the wellbore which is being used for steam injection. This may allow for monitoring of the temperature profile and the acoustic profile of the steam injection line and optionally pressure sensing of the steam injection line. In such a case an optical fibre used for sensing may preferably extend for the whole length of the section of the well used for steam injection. However in some embodiments optical fibre(s) for sensing could additionally or alternatively be placed in a wellbore used just for production, in the vicinity of an injection wellbore.

The method may therefore involve using a DTS interrogator for interrogating the first optical fibre and using a coherent Rayleigh interrogator for interrogating the second optical fibre. The coherent Rayleigh interrogator may be a DAS-type interrogator which is able to detect any variation between interrogations due to temperature variations, i.e. is capable of DTGS. The DTS interrogator and coherent Rayleigh interrogator may be separate units or a single interrogator unit may be arranged to perform both functions.

As mentioned above the DTS interrogator and coherent Rayleigh interrogator may be arranged to interrogate the same optical fibre, i.e. the second optical fibre is the same as the first optical fibre. In this case interrogations for DTS could be interspersed with interrogations for DTGS. In some embodiments it may be possible to transmit a series of interrogating pulses that are suitable for both DTS measurements and include a coherent pulse of interrogating radiation for DTGS measurements. Any radiation which is Rayleigh backscattered may be analysed for DTGS separately from any radiation which is Brillouin and/or Raman scattered (although in some DTS sensors a measure of the Rayleigh backscatter may be used in the processing). In some embodiments separate interrogations designed for DTS and DTGS may be transmitted into the fibre and wavelength division multiplexing techniques may be used to separate the backscatter accordingly.

In some embodiments however there may be separate optical fibre for DTS and for DTGS.

Where the method also involves DAS sensing there may be first and second coherent Rayleigh interrogators for DTGS and DAS sensing respectively, which may or may not act on the same optical fibre. However in at least some embodiments the same coherent Rayleigh interrogator may be used for both DTGS and DAS sensing, possible using a single series of interrogations with processing to provide a DTGS profile and a DAS profile based on predetermined parameters.

The spatial resolution of the fibre optics sensors, i.e. the size of the sensing portions of the DTS sensor, the DTGS and/or the DAS sensor may be set to any suitable size as appropriate. In embodiments where the same optical fibre is used for both DTS and DTGS, or separate fibres are used but are laid on substantially the same path as one another, the size and spacing of the sensing portions of fibre for DTS may be substantially the same as the size and spacing of the sensing portions of fibre for DTGS (and/or DAS). This may ease processing of the various temperature and acoustic profiles. However it will be understood that the various sensing portions may have different sizes or alignments as implemented in the different sensors.

The method may be operated in real time before, during and/or after a steam injection phase. In some embodiments the method may provide a steam injection profile which may be of use to control personnel for setting the control parameters for steam injection. In at least some embodiments however the method may involve automatically controlling at least one aspect of steam injection based on the determined steam profile. The method may for instance control at least one of, steam injection flow rate, steam injection pressure, steam injection temperature, and/or valve setting of one or more selectively controllable downwell valves. The method may adjust such parameters to maintain the steam injection profile within one or more predetermined ranges or limits.

The method also relates to a method of processing data. Thus in another aspect there is provided a method of determining a steam injection profile comprising:

taking a first temperature profile of at least a first portion of a well obtained by distributed temperature sensing on a first fibre optic deployed along said first portion of the well;

taking a second temperature profile of at least the first portion of a well obtained by repeatedly launching interrogations of one or more pulses of coherent radiation into a second fibre optic, detecting any radiation which is Rayleigh backscattered from each interrogation and analysing the detected backscattered radiation to detect any variation between interrogations due to temperature variations; and combining said first and second temperature profiles to provide a steam injection profile.

The processing method according to this aspect of the method offers the same advantages and can implemented in all of the same variants as discussed above in relation to the first aspect of the invention.

The invention also relates to computer software, which may be stored on a non-transitory storage medium for implementing any of methods described above, e.g. when run on a suitable computing device.

In another aspect of the invention there is provided an apparatus for determining a steam injection profile comprising:

a distributed temperature sensor for performing distributed temperature sensing on a first fibre optic deployed along at least a first portion of a well so as to obtain a first temperature profile of said first portion of said well;

a coherent Rayleigh sensor for interrogating a second fibre optic deployed along at least said first portion of said well to provide distributed sensing of temperature variations so as to obtain a second temperature profile of the first portion of the well, said coherent Rayleigh sensor being configured to repeatedly launch interrogations of one or more pulses of coherent radiation into said second fibre optic, detecting any radiation which is Rayleigh backscattered from each interrogation and analyse the detected backscattered radiation to detect any variation between interrogations due to temperature variations; and a processor configured to combine said first and second temperature profiles to provide a steam injection profile.

The apparatus of this aspect of the invention offers all of the same advantages and may be implemented in all of the same variants as described above in respect to the methods.

In particular the coherent Rayleigh interrogator may be a DAS-type interrogator which is able to detect any variation between interrogations due to temperature variations, i.e. is capable of DTGS. The DTS interrogator and coherent Rayleigh interrogator may be separate units or a single interrogator unit may be arranged to perform both functions. There may also be a DAS interrogator for obtaining an acoustic profile. The DAS interrogator may be the same as the coherent Rayleigh interrogator. The apparatus may also comprise a data interface for at least downwell pressure sensor and/or at least one downwell point temperature sensor. The processor may also be configured to receive data on one or more wellhead steam flow parameters.

DESCRIPTION OF THE DRAWINGS

The invention will now be described by way of example only with respect to the accompanying drawings, of which.

DESCRIPTION OF THE INVENTION

Figure 1:
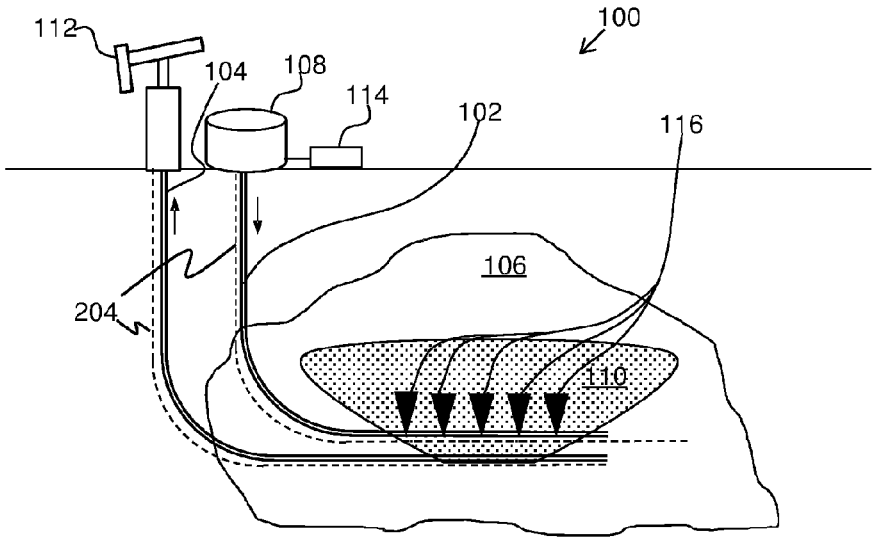
FIG. 1 illustrates an example of a steam assisted well

In various well completions steam may be injected into the well at some point during the lifetime of the well in order to improve yield. FIG. 1 shows one example of Steam Assisted Gravity Drainage (SAGD) well 100.

As will be familiar to the skilled person, a SAGD well 100 is typically formed by drilling two bore holes to serve as an 'injection' shaft 102 and a 'production' shaft 104. Both bore holes may be arranged to have substantially horizontal portions, with the horizontal injection shaft 102 being arranged a few meters above the production shaft 104 but substantially parallel thereto. Both horizontal shaft portions are drilled so as to run through an underground resource reservoir 106, which in the case of a SAGD well 100 is typically a viscous oil or bitumen reservoir (the term 'oil' as used herein should be understood as including all such resources).

In use of the SAGD well 100, a steam generator 108 is used to generate steam which is released into the reservoir 106 from the horizontal portion of the injection shaft 102. This steam heats the resource within the reservoir 106, decreasing its viscosity. Over time, the steam forms a steam chamber 110, which allows the heated resource to flow to the horizontal portion of the production shaft 104, which collects the resource, which is in turn pumped to the surface by pumping apparatus 112. The apparatus further comprises a controller 114 in association with the injection shaft 202. In some embodiments this controller 214 may be arranged to control valves within the injection shaft 102 to selectively release steam therefrom. In this particular example, five individual valves producing five distinct plumes of steam 116 into the chamber 110 are illustrated. However, it will be appreciated that a real system could be several kilometers in length and there may be many more valves provided.

As will be familiar to the skilled person, while the arrangement above is fairly typical, variations are known, such as using the production shaft 1104 to introduce steam at least in the initial stages of heating. Other similar schemes which use steam to heat a reservoir are also known, including Cyclic Steam Stimulation, in which one shaft is used alternately as a production shaft and an injection shaft, and steam flooding, in which oil is both heated by steam released form one or more injection shafts, and urged towards a production well. Any such methods could benefit from the use of the general principles described herein, and constitute methods of steam stimulation which may be employed in steam stimulated wells.

In order to allow efficient steam injection and to ensure that steam is delivered in the desired manner, for instance to ensure a desired shape of steam cavity or the like, it would be beneficial to be able to be able to monitor the steam flow profile as steam is injected into a well.

Thus in embodiments of the present invention the injection well 102 may be provided with at least one fibre optic cable 204 deployed along the length of the well running from the well head, down the vertical section and along the length of the horizontal section used for steam injection. The, or each fibre optic cable 204, is connected to a fibre optic interrogator 206 as illustrated in FIG. 2.

Figure 2:
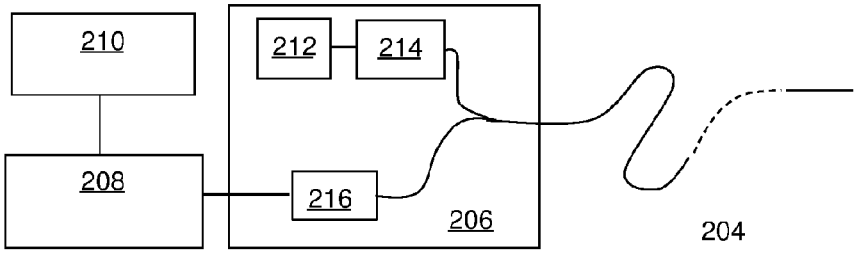
FIG. 2 illustrates components of a coherent Rayleigh distributed fibre optic sensor as used in embodiments of the present invention.

FIG. 2 shows a schematic of a distributed fibre optic sensing arrangement. A length of sensing fibre 204 is removably connected at one end to an interrogator 206. The output from interrogator 206 is passed to a signal processor 208, which may be co-located with the interrogator or may be remote therefrom, and optionally a user interface/graphical display 210, which in practice may be realised by an appropriately specified PC. The user interface 210 may be co-located with the signal processor 208 or may be remote therefrom.

The sensing fibre 204 can be many kilometers in length, for example at least as long as the depth of a wellbore which may typically be around 1.5 km long. In this example, the sensing fibre is a standard, unmodified single mode optic fibre such as is routinely used in telecommunications applications without the need for deliberately introduced reflection sites such a fibre Bragg grating or the like. The ability to use an unmodified length of standard optical fibre to provide sensing means that low cost, readily available fibre may be used. However in some embodiments the fibre may comprise a fibre which has been fabricated to be especially sensitive to incident vibrations, or indeed may comprise one or more point sensors or the like. In use the fibre 204 is deployed to lie along the length of a wellbore, such as in a production or injection well shaft as described above in relation to FIG. 1.

As the skilled person is aware various types of distributed fibre optic sensing are known.

Distributed temperature sensing (DTS) is a known technique where a single length of longitudinal fibre is optically interrogated, usually by one or more input pulses, to provide substantially continuous sensing of temperature along its length. Optical pulses are launched into the fibre and radiation which is Brillouin and/or Raman scattered within the fibre can be detected and analysed to determine a temperature profile for each of a plurality of sensing portions of fibre. One skilled in the art will be well aware of various DTS sensors which may be implemented in embodiments of the present invention.

Distributed acoustic sensing (DAS) is another known type of sensing whereby a single length of longitudinal fibre is optically interrogated, usually by one or more input pulses, to provide substantially continuous sensing of vibrational activity along its length. Optical pulses are launched into the fibre and the radiation backscattered from within the fibre is detected and analysed. By analysing the radiation Rayleigh backscattered within the fibre, the fibre can effectively be divided into a plurality of discrete sensing portions which may be (but do not have to be) contiguous. Within each discrete sensing portion mechanical vibrations of the fibre, for instance from acoustic sources, cause a variation in the amount of radiation which is backscattered from that portion. This variation can be detected and analysed and used to give a measure of the intensity of disturbance of the fibre at that sensing portion.

Accordingly, as used in this specification the term "distributed acoustic sensor" will be taken to mean a sensor comprising an optic fibre which is interrogated optically to provide a plurality of discrete acoustic sensing portions distributed longitudinally along the fibre and acoustic shall be taken to mean any type of mechanical vibration or pressure wave, including seismic waves. Note that as used herein the term optical is not restricted to the visible spectrum and optical radiation includes infrared radiation and ultraviolet radiation.

Since the fibre has no discontinuities, the length and arrangement of fibre sections corresponding to each channel is determined by the interrogation of the fibre. These can be selected according to the physical arrangement of the fibre and the well it is monitoring, and also according to the type of monitoring required. In this way, the distance along the fibre, or depth in the case of a substantially vertical well, and the length of each fibre section, or channel resolution, can easily be varied with adjustments to the interrogator changing the input pulse width and input pulse duty cycle, without any changes to the fibre. Distributed acoustic sensing can operate with a longitudinal fibre of 40 km or more in length, for example resolving sensed data into 10 m lengths. In a typical downhole application a fibre length of a few kilometers is usual, i.e. a fibre runs along the length of the entire borehole and the channel resolution of the longitudinal sensing portions of fibre may be of the order or 1 m or a few meters. The spatial resolution, i.e. the length of the individual sensing portions of fibre, and the distribution of the channels may be varied during use, for example in response to the detected signals.

In operation, the interrogator 206 launches interrogating electromagnetic radiation, which may for example comprise a series of optical pulses having a selected frequency pattern, into the sensing fibre 204. The optical pulses may have a frequency pattern as described in GB patent publication GB2,442,745 the contents of which are hereby incorporated by reference thereto. As described in GB2,442,745, the phenomenon of Rayleigh backscattering results in some fraction of the light input into the fibre being reflected back to the interrogator, where it is detected to provide an output signal which is representative of acoustic disturbances in the vicinity of the fibre. The interrogator 206 therefore conveniently comprises at least one laser 212 and at least one optical modulator 214 for producing a plurality of optical pulse separated by a known optical frequency difference. The interrogator also comprises at least one photodetector 216 arranged to detect radiation which is Rayleigh backscattered from the intrinsic scattering sites within the fibre 204.

The signal from the photodetector is processed by signal processor 208. The signal processor conveniently demodulates the returned signal based on the frequency difference between the optical pulses, for example as described in GB2,442,745. The signal processor may also apply a phase unwrap algorithm as described in GB2,442,745. The phase of the backscattered light from various sections of the optical fibre can therefore be monitored. Any changes in the effective path length from a given section of fibre, such as would be due to incident pressure waves causing strain on the fibre, can therefore be detected. Further examples of pulses and processing techniques are provided by WO2012/137021 and WO2012137022.

The form of the optical input and the method of detection allow a single continuous fibre to be spatially resolved into discrete longitudinal sensing portions. That is, the acoustic signal sensed at one sensing portion can be provided substantially independently of the sensed signal at an adjacent portion. Such a sensor may be seen as a fully distributed or intrinsic sensor, as it uses the intrinsic scattering processed inherent in an optical fibre and thus distributes the sensing function throughout the whole of the optical fibre.

To ensure effective capture of the signal, the sampling speed of the photodetector 216 and initial signal processing is set at an appropriate rate. In most DAS systems, to avoid the cost associated with high speed components, the sample rate would be set around the minimum required rate.

As mentioned above, the fibre 204 is interrogated to provide a series of longitudinal sensing portions or 'channels', the length of which depends upon the properties of the interrogator 106 and generally upon the interrogating radiation used. The spatial length of the sensing portions can therefore be varied in use, even after the fibre has been installed in the wellbore, by varying the properties of the interrogating radiation. This is not possible with a convention geophone array, where the physical separation of the geophones defines the spatial resolution of the system. The DAS sensor can offer a spatial length of sensing portions of the order of 10 m.

As the sensing optical fibre 204 is relatively inexpensive, it may be deployed in a wellbore location in a permanent fashion as the costs of leaving the fibre 204 situ are not significant. The fibre 204 is therefore conveniently deployed in a manner which does not interfere with the normal operation of the well.

The principles of DAS sensing using coherent Rayleigh backscatter can be used to detect any dynamic change affecting the path length of a sensing portion of fibre. This can include temperature variations. Thus the principles of DAS using coherent Rayleigh backscatter can be used to detect temperature variations.

Such a technique is able to measure very small temperature gradient effects. This sensing technique shall be referred to herein as Distributed Temperature Gradient Sensing (DTGS). Unlike DTS no integration is needed therefore these measurements can be made in real-time and can resolve temperature of less than a milli-Kelvin (mK) However the measurement is of the absolute temperature change rather than the scalar temperature value of DTS.

Embodiments of the present invention make use of both DTS and DTGS to produce a combined temperature profile that can be used to determine a steam injection profile. In some embodiments a DAS profile, i.e. a profile indicating signals detected at acoustic frequencies using a DAS sensor may also be used, possible together with additional point measurements.

Figure 3:
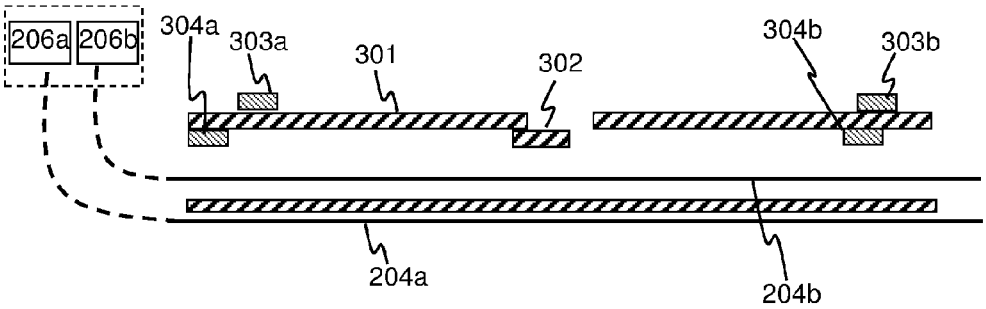
FIG. 3; illustrates an embodiment of the present invention.

FIG. 3 shows a basic embodiment of the invention. FIG. 3 illustrates a horizontal section of well casing 301—which could be an outer well casing or a well casing forming part of a steam injection line or some intermediate casing. A first fibre optic 204*a* runs along the path of the well casing. The first fibre optic 204*a* runs through the vertical section of well, not illustrated for clarity, and connects to a first interrogator 206*a* which is a DTS interrogator. In this embodiment a second fibre optic 204*b* also runs along the length of the well casing and connects at the well head to an interrogator 206*b* which is a coherent Rayleigh interrogator capable of performing DTGS sensing, i.e. DAS type sensing for temperature variations. In some embodiments the interrogator 206*b* may also be capable of performing DAS measurements for acoustic stimuli acting on the fibre 204*b*. In some embodiments the two interrogators may be part of a single unit and may share at least some components. In some embodiments the two interrogator may operate using a single fibre optic, for instance just fibre 204 illustrated in FIG. 1.

The well casing 301 includes at least one steam vent 302 may, in some embodiments comprise a controllable valve. It will be appreciated that there may be many more vents in practice.

The DTS interrogator interrogates the first optical fibre 204*a* to monitor the absolute temperature along the monitored section of the well, including before, in the vicinity of and after the vent.

This will provide an absolute measure of temperature profile along the well. Whilst the temperature profile provided by DTS sensing is useful the need to integrate the DTS returns means that the temperature profile is slow to react to any changes. Also there may be limit to the resolvable temperature resolution. Thus the interrogator 206*b* also interrogates the second optical fibre 204*b* to perform DTGS. As mentioned DTGS allows determination of temperature changes with a resolution of the order of about 1 mK or less, i.e. temperature changes of less than 1 mK can be resolved, and is fast acting. However the temperature profile provided by DTGS is a relative profile of temperature changes and not an absolute profile. In embodiments of the present invention however a suitable processor such as processor 208 and/or controller 114 may be arranged to combine the two temperature profiles to produce a resultant temperature profile which is accurate, provided fine resolution and fast update but also provides absolute values.

In order to full characterise the steam profile embodiments of the invention may also use additional data. The interrogator 206*b* may be also arranged to obtain a DAS profile of the acoustic signals along the well length. There may also be at least first and second point temperature sensors 303*a* and 303*b* arranged to monitor the temperature to a high resolution and accuracy at the beginning and end say of the monitored section of well, say the knee portion (where the horizontal section begins) and the tow portion (near the distal end of the well). Likewise there pressure sensors 304*a* and 304*b* which may again for instance be located at the beginning and end say of the monitored section of well.

A combination of five independent measurements, as set out in table 1 below, from pressure and temperature gauges at the heel and toe, DTS, DAS and DTGS may be used to provide a unique data set that that shall be used to determine the steam flow profile along a horizontal well. This data may be used in addition to data from the wellhead such as surface pump data, temperature, flow rate, steam quality etc.

TABLE 1

| | |
|---|---|
| Point pressure (P) | Point measurement (at heel & toe) |
| Point temperature (T) | Point measurement (at heel & toe) |
| Distributed Temperature Sensing (DTS) | Distributed measurement |
| Distributed Acoustic Sensing (DAS) | Distributed measurement |
| Distributed Temperature Gradient Sensing (DTGS) | Distributed measurement |

Adding to DTS measurements, discrete point high-resolution and high-accuracy P&T measurements in the annulus provides more constraints for the dual-phase model and adds long-term absolute temperature accuracy to DTS. The referenced DTS measurements can then be used to provide a distributed scalar temperature reference onto which the DTGS fine resolution absolute temperature gradient measurements can be mapped.

Figure 4:
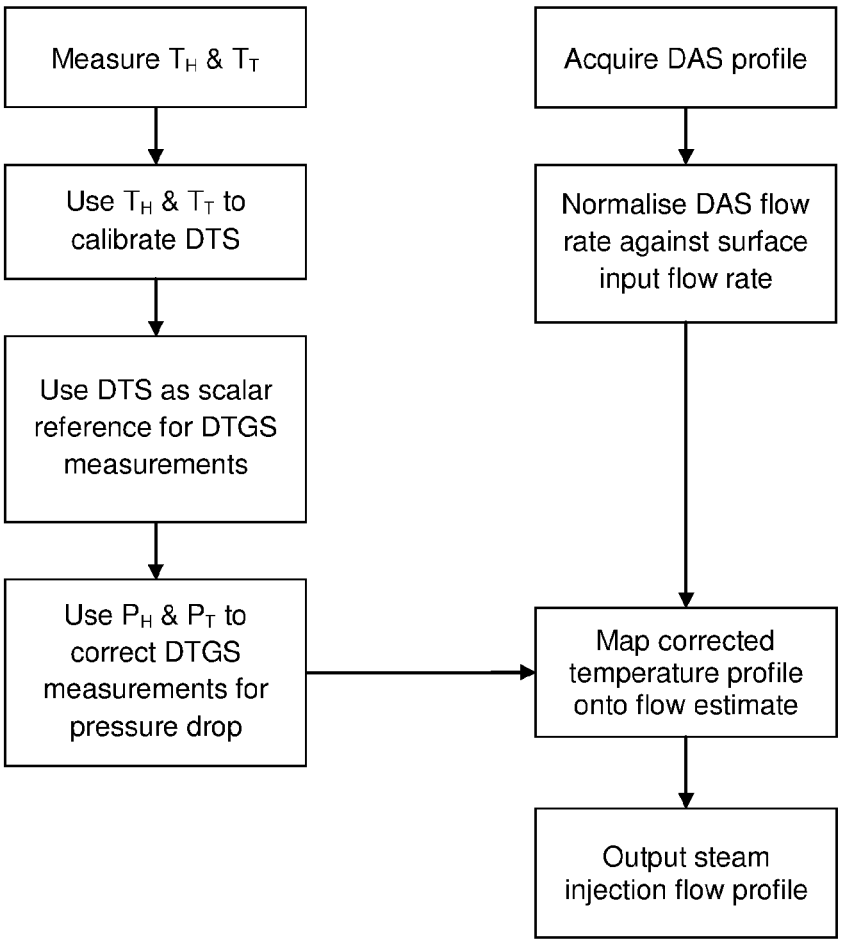
FIG. 4 illustrates a flow chart of one embodiment of a method of the invention.

FIG. 4 illustrates a flowchart to illustrate one example of a method for determining highly accurate temperature profile along the length of a horizontal well and to relate that to the flow characteristics also measured in the well. With the multiple measurements available using the fibre-optic sensors proposed it will be possible to solve for unknown terms in equations the different flow characteristics of steam and vapour.

Saturated steam and its flow regime in a well are highly dependent to both pressure and temperature. Accurate pressure and temperature measurements can therefore be very useful for steam flooding operations and testing. When referenced against the point sensor measurements at the heel and toe of the well DTS/DTGS technology offer accurate temperature profile measurement capabilities over the length of the well. DAS technology cannot measure pressure but can deliver information about the steam flow profile over the length of the well. The combination of DAS, DTGS, DTS and the single point P/T measurements bring valuable information for a better comprehension of the steam flow regime in different parts of the reservoir.

The invention has been described with respect to various embodiments. Unless expressly stated otherwise the various features described may be combined together and features from one embodiment may be employed in other embodiments.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The invention claimed is:

1. A method of monitoring steam injection in a steam assisted well comprising:

obtaining a first temperature profile of at least a first portion of a well by performing distributed temperature sensing on a first fibre optic deployed along said first portion of the well, wherein performing said distributed temperature sensing comprises repeatedly interrogating said first fibre optic with optical radiation and directing and analysing radiation with is Brillouin and/or Raman scattered from within said first fibre optic;

obtaining a second temperature profile of at least the first portion of a well by interrogating a second fibre optic deployed along the first portion of the well to provide distributed sensing of temperature variations, wherein interrogating said second fibre optic comprises repeatedly launching interrogations of one or more pulses of coherent radiation into said second fibre optic, detecting any radiation which is Rayleigh backscattered from each interrogation and analysing the detected backscattered radiation to detect any variation between interrogations due to temperature variations; and combining said first and second temperature profiles to provide a steam injection profile.

2. A method as claimed in claim 1 wherein said first temperature profile is a temperature profile along the steam injection line of the well.

3. A method as claimed in claim 1 wherein said second temperature profile has a temperature resolution of 1 mK or less.

4. A method as claimed in claim 1 comprising using the first temperature profile as a reference profile for the second temperature profile to create a resultant temperature profile.

5. A method as claimed in claim 4 wherein the first temperature profile is modulated by the temperature variations indicated by the second temperature profile.

6. A method as claimed in claim 1 comprising taking at least one temperature measurement from at least point temperature sensor located at a location along the first portion of the well.

7. A method as claimed in claim 6 wherein said at least one temperature measurement from said at least one point temperature sensor is within a well casing.

8. A method as claimed in claim 6 comprising calibrating the first temperature profile based on the measurement from the at least one point temperature sensor.

9. A method as claimed in claim 6 wherein there are at least two point temperature sensors and wherein the well has a substantially horizontal section between a heel portion and a toe portion and one of said point temperature sensor is located in the heel portion and another of said point temperature sensors is located in the toe portion.

10. A method as claimed in claim 1 comprising taking at least one pressure measurement from a pressure sensor located at a location along the first portion of the well.

11. A method as claimed in claim 10 wherein said at least one pressure measurement from a pressure sensor is within a well casing.

12. A method as claimed in claim 10 wherein the steam injection profile comprises a measure of the pressure variation along the first portion of well.

13. A method as claimed in claim 10 wherein the pressure determined along the first portion of well is adjusted to compensate for pressure induced variations in the temperature measurements.

14. A method as claimed in claim 1 wherein said first fibre optic is also said second fibre optic.

15. A method as claimed in claim 1 further comprising obtaining a first acoustic profile of at least the first portion of a well by performing distributed acoustic sensing on a third fibre optic deployed along said first portion of the well.

16. A method as claimed in claim 15 wherein the acoustic profile is combined with data regarding the steam flow rate at the wellhead.

17. A method as claimed in claim 16 wherein the first acoustic profile is normalised based on the flow rate of steam at the well head.

18. A method as claimed in claim 15 comprising combining the acoustic profile and the first and second temperature profiles to form the steam injection profile.

19. A method as claimed in claim 1 further comprising obtaining a first acoustic profile of at least the first portion of a well by performing distributed acoustic sensing on one of the first or second fibre optics.

20. A method as claimed in claim 1 wherein the steam injection profile is also based on at least one well head measurement wherein said well head measurement comprises at least one of: steam flow rate; surface steam temperature; surface steam pressure; and steam quality.

21. A method as claimed in claim 1 comprising forming a model of steam flow within the well and using at least the first and second temperature profiles to determine a modelled steam flow profile that matches that measured profiles.

22. A method as claimed in claim 1 wherein the method is operated in real time during a steam injection phase.

23. A method as claimed in claim 1 wherein the steam injection profile is used to set one or more control parameters for steam injection.

24. An apparatus for determining a steam injection profile comprising:

a distributed temperature sensor for performing distributed temperature sensing on a first fibre optic deployed along at least a first portion of a well so as to obtain a first temperature profile of said first portion of said well, wherein performing said distributed temperature sensing comprises repeatedly interrogating said first fibre optic with optical radiation and directing and analysing radiation with is Brillouin and/or Raman scattered from within said first fibre optic;

a coherent Rayleigh sensor for interrogating a second fibre optic deployed along at least said first portion of said well to provide distributed sensing of temperature variations so as to obtain a second temperature profile of the first portion of the well, said coherent Rayleigh sensor being configured to repeatedly launch interrogations of one or more pulses of coherent radiation into said second fibre optic, detecting any radiation which is Rayleigh backscattered from each interrogation and analyse the detected backscattered radiation to detect any variation between interrogations due to temperature variations; and a processor configured to combine said first and second temperature profiles to provide a steam injection profile.

* * * * *